US010640175B2

(12) United States Patent
Knapp

(10) Patent No.: US 10,640,175 B2
(45) Date of Patent: May 5, 2020

(54) FLOATING OBJECT ATTACHMENT SYSTEM

(71) Applicant: Timothy Knapp, Silverdale, WA (US)

(72) Inventor: Timothy Knapp, Silverdale, WA (US)

( * ) Notice: Subject to any disclaimer, the term of this patent is extended or adjusted under 35 U.S.C. 154(b) by 0 days.

(21) Appl. No.: 16/141,389

(22) Filed: Sep. 25, 2018

(65) Prior Publication Data

US 2019/0092432 A1 Mar. 28, 2019

Related U.S. Application Data

(60) Provisional application No. 62/563,349, filed on Sep. 26, 2017.

(51) Int. Cl.

| | |
|---|---|
| ***B63B 21/24*** | (2006.01) |
| ***B63B 21/50*** | (2006.01) |
| ***B63C 1/02*** | (2006.01) |
| ***B63B 21/04*** | (2006.01) |
| ***B63B 35/34*** | (2006.01) |

(52) U.S. Cl.

CPC ..... *B63B 21/50* (2013.01); *B63B 21/04* (2013.01); *B63B 35/34* (2013.01); *B63C 1/02* (2013.01)

(58) Field of Classification Search

CPC ..... B63B 21/20; B63B 2021/20; B63B 21/50; B63B 2021/50; B63C 1/02

USPC ..... 114/293

See application file for complete search history.

(56) References Cited

U.S. PATENT DOCUMENTS

| | | | | |
|---|---|---|---|---|
| 3,496,900 A * | 2/1970 | Mott | B63B 21/27 114/296 |
| 4,624,645 A * | 11/1986 | Kiely | B63B 22/02 405/207 |
| 5,510,022 A * | 4/1996 | Mullis | B01F 3/0473 210/170.06 |
| 8,439,601 B2 * | 5/2013 | Lara | B63B 21/00 248/316.1 |

* cited by examiner

*Primary Examiner* — Daniel V Venne

(74) *Attorney, Agent, or Firm* — Dean A. Craine; Marisa C. Whitaker

(57) ABSTRACT

A floating object attachment system for attaching one end of a rope or cable attached at its opposite end to a submerged anchor. The attachment system includes a rigid support pole attached to a mounting plate attached to the bottom surface of a floating object. Attached to the support pole is a swivel arm adapted to rotate freely 360 degrees around the support pole. A plurality of radially aligned gussets hold the support arm perpendicular to the mounting plate. The swivel arm includes a horizontal flange with a center bore that receives the support pole and a lateral, downward extending diagonal arm with a grommet hole that connects to the rope or cable. The support pole includes a lower stop surface and an upper stop surface on the support pole. Disposed around the support pole and between the horizontal flange and the upper and lower stop surfaces are nylon washers.

6 Claims, 2 Drawing Sheets

FLOATING OBJECT ATTACHMENT SYSTEM

This utility patent application is based on and claims the filing date benefit of U.S. Provisional patent application (Application No. 62/563,349) filed on Sep. 26, 2017.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to connectors adapted to connect to the end of a rope or cable, and more particularly, to such connectors mounted to the bottom surface of a floating object that selectively connect to a rope or cable attached to an anchor that holds the floating object in a restricted area over the anchor.

2. Description of the Related Art

It is common to tie a floating dock or raft to a rope or cable attached to an anchor. During use, waves, wind and tides cause the floating dock or raft to drift back and forth in a restricted area on the water above the anchor.

It is also common to attach the end of the rope or cable to a single cleat or to a ring attached to the side or top surface of the dock or raft. Because cleats and rings are fixed structures, forces exerted on them by the rope or cable cause the dock or raft to rotate in the water so that the side of the dock or raft with the cleat or ring faces the anchor. Also, because the cleat or ring are attached to the side or top surface of the dock or raft, repetitive lateral and vertical forces are exerted on the cleat or ring causing the cleat or ring to loosen and eventually disconnect from the dock or raft.

Ideally, what as is needed is an improved attachment system for restricting movement of a floating dock or raft over a submerged anchor that does not cause the dock or raft to rotate to a particular orientation and is better suited to withstand the repetitive forces exerted on a floating dock or raft.

SUMMARY OF THE INVENTION

An improved floating object attachment system for attaching one end of a rope or cable attached at one end to a submerged anchor. The system includes use of a rotating swivel arm mounted on a support pole that extends downward from the bottom surface of the floating object, such as a floating dock or raft. The support pole is attached to a rigid mounting plate that attaches to the bottom surface of the floating object. The swivel arm includes a horizontal flange that attaches at one end to the support pole and extends laterally. Integrally formed or attached to the distal end of the horizontal flange is an outward extending diagonal flange with a grommet attached at its distal end that connects to an anchor rope or cable. Because the swivel arm rotates freely around the support pole and the diagonal flange is angled downward, tension on the anchor rope or cable does not cause the floating object to rotate in the water and the anchor rope or cable stays clear of the support pole.

The support pole includes a plurality of radially aligned gussets that securely hold the support arm in a fixed perpendicularly aligned position on the mounting plate. The support pole includes a lower stop surface and an upper stop surface that holds the swivel arm on the support pole. Nylon washers are placed around the support arm and between the swivel arm and the upper and lower stop surfaces.

DESCRIPTION OF THE PREFERRED EMBODIMENT(S)

Figure 1:
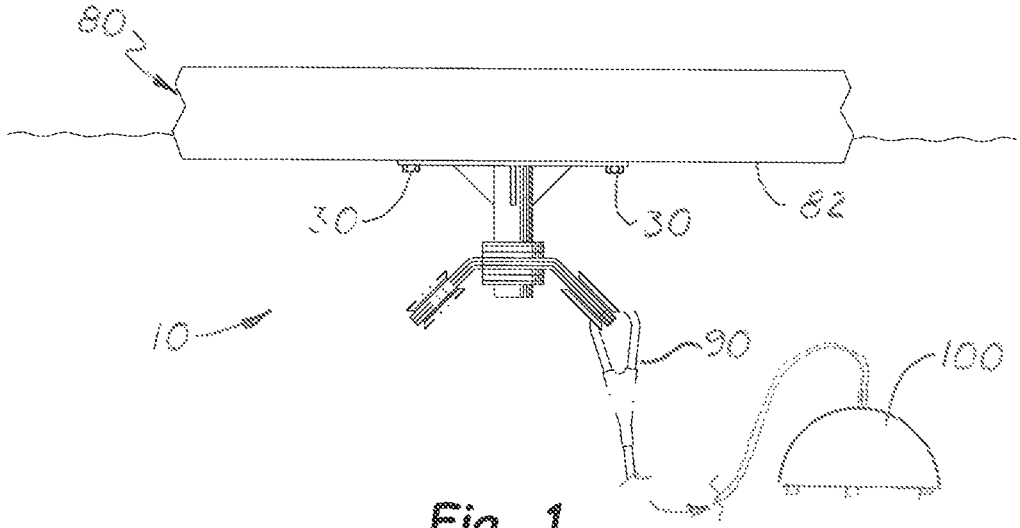
FIG. 1 is an illustration of the floating object attachment system described herein mounted on the bottom surface of a floating object, such as a dock or raft.
Figure 2:
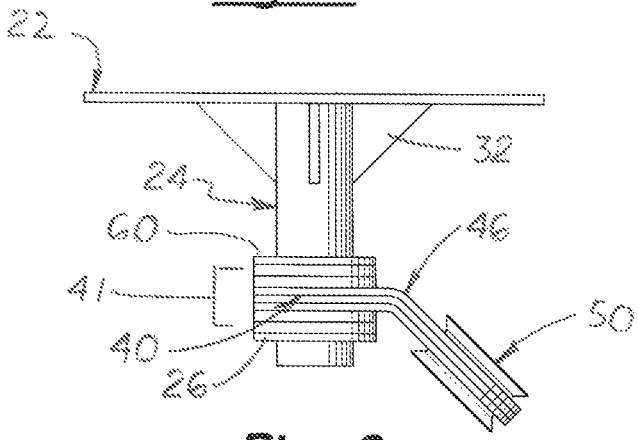
FIG. 2 is a side elevational view of the attachment system.
Figure 3:
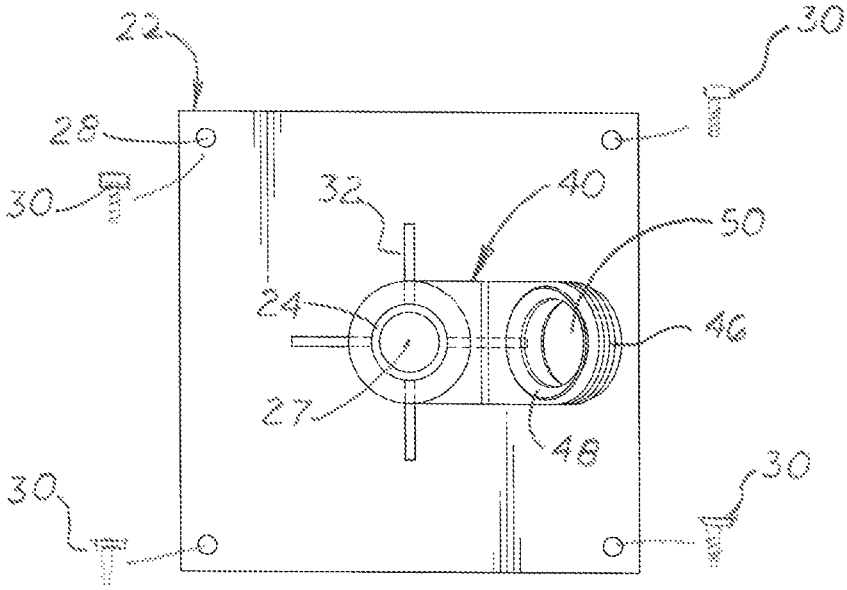
FIG. 3 is a top plan view of the attachment system shown in FIG. 2.
Figure 4:
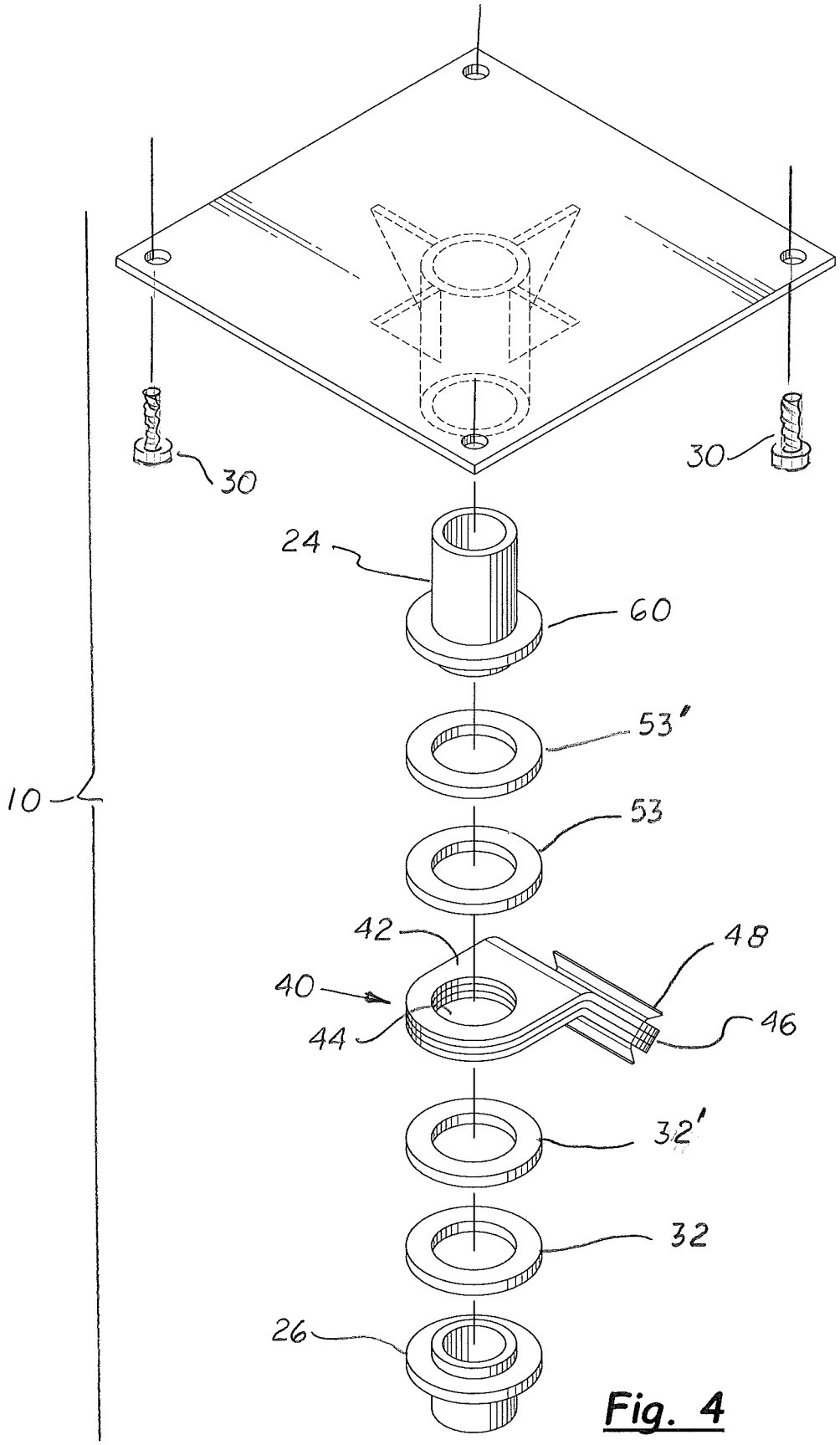
FIG. 4 is an exploded perspective view of the attachment system.

Referring to the FIGS. 1-4, there is shown an improved floating object attachment system 10 for attaching one end of an anchor rope or cable 90 to a submerged anchor 100. The attachment system 10 includes a mounting plate 26 with a perpendicularly aligned support pole 24 attached thereto. Attached to the support pole 24 is a free rotating swivel arm 46.

The mounting plate 22 is a rigid plate structure made of metal configured to attached to a flat bottom surface 82 of a floating object 80. The mounting plate 22 includes a plurality of holes 28 that received suitable connectors 30 used to securely attach the mounting plate 26 to the bottom surface 82 of the floating object 80.

The support pole 24 is a solid or hollow pipe affixed to the mounting plate 26 and aligned with the plate's center axis 27. A plurality of radially aligned gussets 32 are attached to the mounting plate 22 and to the support pole 24. The gussets 32 hold the support arm 24 perpendicularly aligned with the mounting plate 22.

The swivel arm 40 includes a horizontal flange 42 with a center bore 44 adapted to receive the support pole 24. The horizontal flange 42 is perpendicularly aligned with the support pole's longitudinal axis. The swivel arm 40 also includes a diagonal flange 46 that extends downward. Formed near the distal end of the diagonal flange 46 is a main hole 50. Inserted into the main hole 50 formed on the diagonal arm 46 is a grommet 48 with curved or beveled edges that reduce abrasions to the rope or cable 90.

The support pole 24 includes a lower stop surface 26 and an upper stop surface 60. The lower stop surface 26 and upper stop surface 60 are spaced apart to form a rotation section 41 for the swivel arm 40 to rotate on the support pole 24. When assembled, the horizontal flange 42 is positioned between the lower and upper stop surfaces 26, 60 so that the rotation section 41 of the support pole 24 extends through the center bore 44 and the diagonal flange 46 points downward. Disposed around the support pole 24 and between the horizontal flange 42 and the lower and upper stop surfaces 26, 60 are at least one nylon washer 32, 53. In the embodiment shown herein, there are two pairs of nylon washers, 32, 32', and 53, 53' respectively.

Inserted into the main hole 50 formed on the diagonal flange 46 is a grommet 48 with curved or beveled edges that reduce abrasions to the rope or cable 90.

In the embodiment shown herein, the support pole 24 is approximately 2 inches in diameter and 9 inches in length. The swivel arm 40 is a plate structure approximately 3 inches in width and 6 inches in length. The horizontal flange 42 is approximately 3 inches in length. The diagonal flange 46 is disposed at a 45 degrees angle from the horizontal flange 42. The center bore 44 formed in the horizontal flange 46 is approximate 2⅛ inches in diameter. The main hole 50 is approximately 2¼ inches in diameter. The stop surfaces 26, 60 are circular plates approximately 3 inches in diameter. In the embodiment shown, the stop surfaces 26, 60 are made of metal and welded to the support pole 24. In should be understood the stop surfaces 26, 60 could be pegs or bolts, that extend laterally from the support pole 24 and permanently or selectively affixed to the support pole 24. The nylon washers 32, 32', 53, 53' are approximately 3 inches in diameter and ¼ inch thick. The support pole 24, the swivel arm 40, the stop surfaces 26, 60 are made of stainless steel or galvanized steel.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A floating object attachment system for attaching a floating object to a submerged anchor, comprising a. a support pole includes a distal end, a proximal end, a lower stop surface and an upper stop surface spaced apart to form a rotation section;

b. a swivel arm that includes a horizontal flange and a diagonal flange, formed on said horizontal flange is a center bore adapted to receive said rotation section on said support pole and allows said swivel arm to rotate 360 degrees in said rotation section on said support pole, said diagonal flange extending downward from said support pole when said support pole is attached to a bottom surface of said floating object, said diagonal flange includes a main hole;

c. at least one nylon washer disposed on said support pole between said horizontal flange and said lower stop surface;

d. at least one nylon washer disposed on said support pole and between said horizontal flange and said upper stop surface; and e. a plurality of connectors for connecting said mounting bracket to said bottom surface of a said floating object.

2. The floating object attachment system, as recited in claim 1, further including a grommet inserted into said main hole formed on said diagonal flange.

3. The floating object attachment system, as recited in claim 1, wherein said support pole and said swivel arm are made of galvanized steel or stainless steel.

4. A floating dock or raft, comprising;

a. a floating dock or raft with a flat bottom surface;

b. a support pole includes lower stop surface and an upper stop surface spaced apart to form a rotation section;

c. a swivel arm that includes a horizontal flange and a diagonal flange, formed on said horizontal flange is a center bore adapted to receive said rotation section on said support pole and allows said swivel arm to rotate 360 degrees in said rotation section on said support pole, said diagonal flange extending downward from said support pole when said support pole is attached to a bottom surface of said floating object, said diagonal flange includes a main hole;

d. at least one nylon washer disposed inside said rotation section and between said horizontal flange and said lower stop surface;

e. at least one nylon washer disposed on said support pole and inside said rotation section and between said horizontal flange and said upper stop surface;

f. a mounting plate attached to said flat bottom surface on said floating dock or raft, said mounting plate being perpendicularly aligned and attached to one end of said support pole enabling said support pole to extend downward into a body of water under said floating dock or raft; and g. a plurality of connectors for connecting said mounting plate to said flat bottom surface of said floating dock or raft.

5. The floating dock or raft, as recited in claim 4, further including a grommet inserted into said main hole formed on said diagonal flange.

6. The floating dock or raft, as recited in claim 4, wherein said support pole and said swivel arm are made of galvanized steel or stainless steel.

* * * * *